US005441223A

United States Patent [19]

Young et al.

[11] Patent Number: 5,441,223

[45] Date of Patent: * Aug. 15, 1995

[54] MODEL TRAIN CONTROLLER USING ELECTROMAGNETIC FIELD BETWEEN TRACK AND GROUND

[75] Inventors: Neil P. Young, 3240 Bear Gulch Rd., Redwood City, Calif. 94062; David M. Hampton, Nevada City, Calif.

[73] Assignee: Neil P. Young, Redwood City, Calif.

[ * ] Notice: The portion of the term of this patent subsequent to Oct. 12, 2010 has been disclaimed.

[21] Appl. No.: 134,102

[22] Filed: Oct. 8, 1993

Related U.S. Application Data

[63] Continuation-in-part of Ser. No. 833,869, Feb. 11, 1992, Pat. No. 5,251,856.

[51] Int. Cl.[6] ..... B61L 7/08; B61L 27/00

[52] U.S. Cl. ..... 246/4; 246/187 A; 104/300; 104/302; 446/455; 340/825.69

[58] Field of Search ..... 246/3, 4, 5, 167 R, 246/187 R, 182 R, 187 A, 187 B, 191, 192 R, 193, 194, 196; 180/167; 104/295, 296, 297, 300, 301, 302, DIG. 1; 340/825.17, 825.07, 825.58, 825.69, 825.72, 310 A; 446/433, 443, 454, 455, 456, 467

[56] References Cited

U.S. PATENT DOCUMENTS

| | | | |
|---|---|---|---|
| 2,221,963 | 11/1940 | Case et al. | 246/4 X |
| 2,606,281 | 8/1952 | Thomas et al. . | |
| 2,622,542 | 12/1952 | Bonanno . | |
| 2,830,148 | 4/1958 | Barger . | |
| 2,963,985 | 12/1960 | Palmer et al. . | |
| 3,220,356 | 11/1965 | Leslie . | |
| 3,293,549 | 12/1966 | Patterson | 26/187 A X |
| 3,315,613 | 4/1967 | Leslie | 104/300 |
| 3,529,216 | 9/1970 | Kolm et al. . | |
| 3,555,270 | 1/1971 | Persson | 246/194 |
| 3,587,100 | 6/1971 | Doremus et al. . | |
| 3,639,755 | 2/1972 | Wrege | 246/187 B |
| 3,699,522 | 10/1972 | Haner, Jr. . | |
| 3,736,484 | 5/1973 | Reynolds et al. | 446/454 X |
| 3,810,099 | 5/1974 | Woods . | |
| 3,964,701 | 6/1976 | Kacerek | 246/187 B X |
| 3,994,237 | 11/1976 | Thomsen | 104/295 |
| 4,207,569 | 6/1980 | Meyer . | |
| 4,334,221 | 6/1982 | Rosenhagen et al. . | |
| 4,335,381 | 6/1982 | Palmer | 246/187 A X |
| 4,349,196 | 9/1982 | Smith, III et al. | 246/5 X |
| 4,390,877 | 6/1983 | Curran | 446/455 X |
| 4,572,996 | 2/1986 | Hanschke et al. | 446/455 X |
| 4,711,418 | 12/1987 | Aver, Jr. et al. . | |
| 4,723,737 | 2/1988 | Mimoun . | |
| 4,914,431 | 4/1990 | Severson et al. | 246/187 B X |
| 5,012,236 | 4/1991 | Troyk et al. . | |
| 5,050,505 | 9/1991 | Konno | 104/295 |
| 5,085,148 | 2/1992 | Konno | 104/295 X |
| 5,146,153 | 9/1992 | Luchaco et al. . | |
| 5,263,670 | 11/1993 | Colbaugh et al. | 246/194 X |

OTHER PUBLICATIONS

Excerpt from Lionel Brochure entitled "Lionel 'E-U-nits'" pp. 231–234.

Copy of Marklin-Digital, Gebr. Marklin & Cie, GmbH, Postfach 8 60/8 80, D-7320 Goppingen, Germany.

"Command Control Roundup", K. Thompson, Model Railroader, Jul. 1993, pp. 88–93.

*Primary Examiner*—Michael S. Huppert
*Assistant Examiner*—Scott L. Lowe
*Attorney, Agent, or Firm*—Townsend and Townsend Khourie and Crew

[57] ABSTRACT

A controller for model trains on a train track is provided. The controller transmits control signals between a rail of the track and earth ground, generating an electromagnetic field which extends for several inches around the track. A receiver in the locomotive can then pick up signals from this electromagnetic field.

14 Claims, 9 Drawing Sheets

MODEL TRAIN CONTROLLER USING ELECTROMAGNETIC FIELD BETWEEN TRACK AND GROUND

This application is a continuation-in-part of application Ser. No. 07/833,869, filed Feb. 11, 1992.

BACKGROUND

The present invention relates to control systems for model trains.

Model train systems have been in existence for many years. In the typical system, the model train engine is an electrical engine which receives power from a voltage which is applied to the tracks and picked up by the train motor. A transformer is used to apply the power to the tracks. The transformer controls both the amplitude and polarity of the voltage, thereby controlling the speed and direction of the train. In HO systems, the voltage is a DC voltage. In Lionel systems, the voltage is an AC voltage transformed from the 60 Hz line voltage available in a standard wall socket.

In addition to controlling the direction and speed of a train, model train enthusiasts have a desire to control other features of the train, such as a whistle. Lionel allows for such control of the whistle by imposing a DC voltage on top of the AC line voltage, which is then picked up by the locomotive. Obviously, this method is limited in the number of controls that can be transmitted, since there are only plus and minus DC levels available, along with varying amplitudes. One method for increasing the number of control signals available by use of a state machine in the locomotive is disclosed in Severson, U.S. Pat. No. 4,914,431.

Another type of control system is shown in Hanschke et al., U.S. Pat. No. 4,572,996. This patent teaches sending address and control signals over a rail line bus to a train. The signals sent appear to be digital pulses. In Kacerek, U.S. Pat. No. 3,964,701, each train locomotive will respond to a different frequency signal. After the corresponding frequency signal is sent to alert the train, it is followed by a voltage level indicating the action to be taken.

Marklin makes a system which puts high power signals differentially between the tracks. These signals are used to provide power to the train's motor as well as for signalling control signals. Other systems use RF transmissions directly to the trains through the air. Still other systems will superimpose a high frequency signal on the track power signal that is applied differentially between the tracks. One problem with such systems is the intermittent contact between the wheels and the track, the noise generated by the brush motors used and intermittent contact due to gaps in the track. The RF transmitters which transmit directly to the trains have the disadvantage of requiring a large antenna, cost and complexity.

SUMMARY OF THE INVENTION

The present invention provides a controller for model trains on a train track. The controller transmits control signals between a rail of the track and earth ground, generating an electromagnetic field which extends for several inches around the track. A receiver in the locomotive can then pick up signals from this electromagnetic field.

This system eliminates the need for control signals to be picked up by electrical contact with the tracks, thus eliminating noise and connection problems. In addition, by using an electromagnetic field only along the track, the extent of the field generated is limited, thus limiting the power required to generate the field and avoiding transmitter licensing requirements. The electromagnetic field can be concentrated by this method to where the receiver on the locomotive actually is.

In addition, the electromagnetic field is transmitted along wires connected to the track to control switches for operating devices along the train track layout. Such devices could include lights, flags, track switches for changing track direction, etc.

The invention preferably includes a microprocessor in a locomotive, with a receiver/demodulator providing received signals to the microprocessor. A manual switch coupled to the locomotive allows it to be put into a program mode. In this program mode, for instance, address information is sent along the track and received by the train and stored in its memory as the address of that locomotive. In this way, each locomotive can be programmed with a different address to which it will respond during normal "run" operation. In addition, switch controllers can be addressed in the same way.

The present invention also preferably uses a triac switch which is controlled by the microprocessor in the locomotive. This triac switch connects between the power on the track and the motor of the train. A normal transformer can be separately connected to the track, and put at the full power position. The triac switch is then used on the locomotive to control the amount of power provided to the motor, and thus control the speed and the direction of the locomotive.

For a fuller understanding of the nature and advantages of the invention, reference should be made to the ensuing description taken in conjunction with the accompanying drawings.

DETAILED DESCRIPTION OF THE PREFERRED EMBODIMENTS

Figure 1:
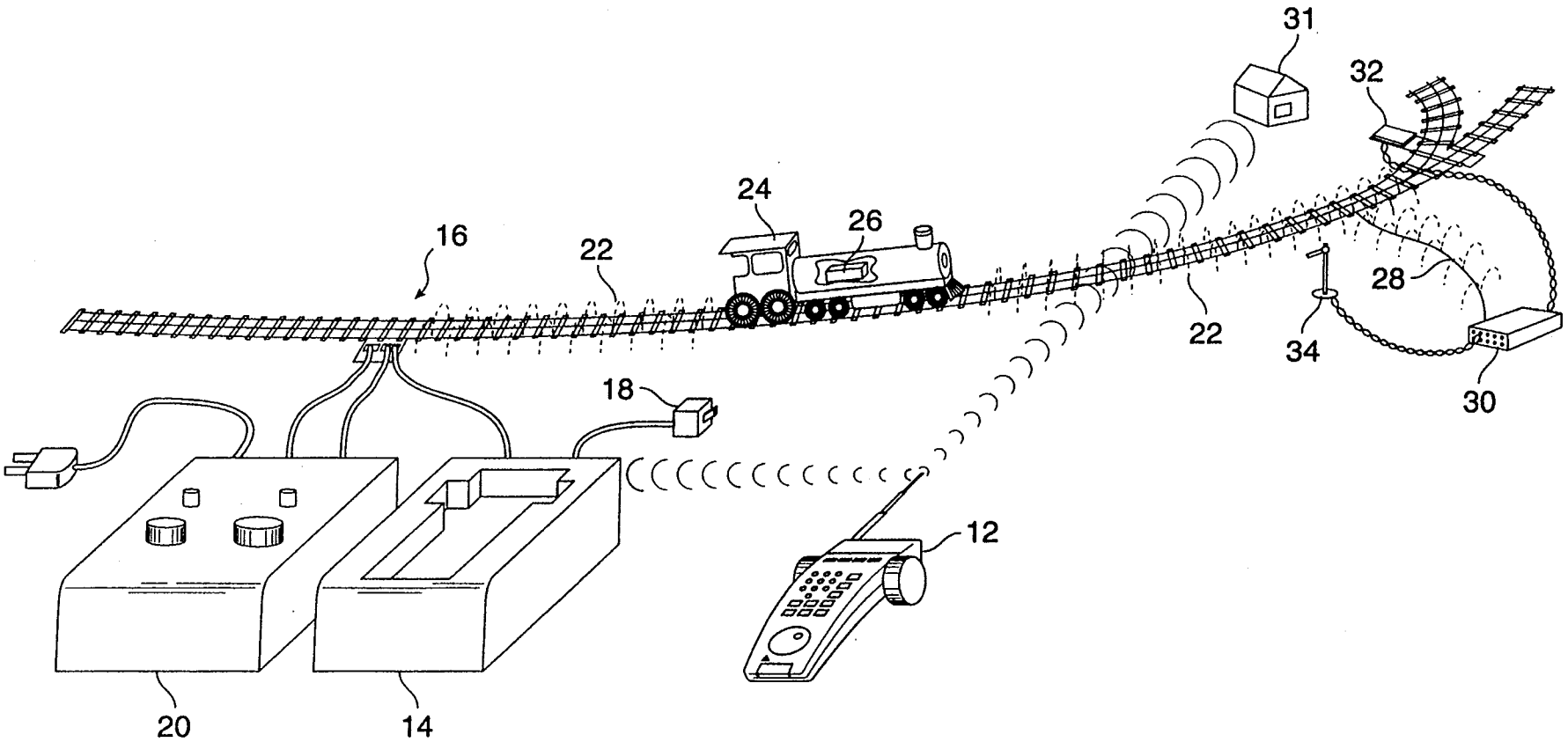
FIG. 1 is a perspective drawing of a layout of a train track system utilizing the present invention.

FIG. 1 is a perspective view of a train layout utilizing the present invention. A hand-held remote control unit 12 is used to transmit signals to a base unit 14 which is connected to train tracks 16. Base unit 14 receives power through an AC adapter 18. A separate transformer 20 is connected to track 16 to apply power to the tracks. In normal operation, the transformer is set on its full setting.

Base unit 14 transmits an RF signal between the track and earth ground, which generates an electromagnetic field indicated by lines 22 which propagates along the track. This field will pass through a locomotive 24 and will be received by a receiver 26 inside the locomotive an inch or two above the track.

The electromagnetic field will also propagate along a line 28 to a switch controller 30. Switch controller 30 also has a receiver in it, and will itself transmit control signals to various devices, such as the track switching module 32 or a moving flag 34 or a device 31.

Figure 2:
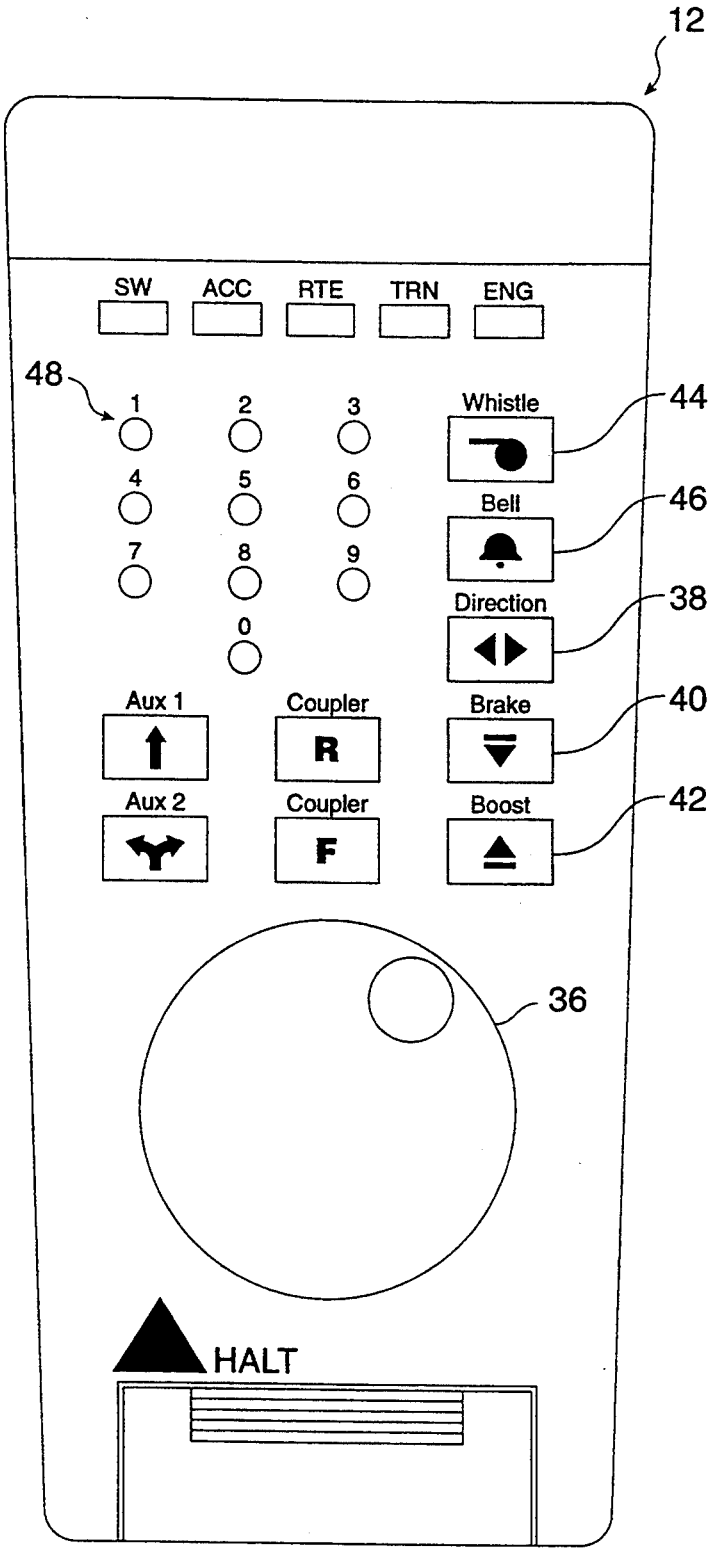
FIG. 2 is a diagram of the exterior of the hand-held remote control unit used for the present invention.

FIG. 2 is a diagram of the housing for remote control unit 12 of FIG. 1. The remote control contains a dial 36 which is used to adjust the speed of an engine. General purpose buttons are provided, as well as special purpose buttons. A direction button 38 allows the direction of a locomotive to be changed. Brake button 40 allows the train to be braked while the button is depressed, with the train returning to the speed set by dial 36 when the brake button is released. Similarly, boost button 42 will boost the train speed, with the train returning to its normal, slower speed set by dial 36. Boost button 42 may be used to give extra power to the train when going up a hill, for instance.

There is also a whistle button 44 and a bell button 46. A numeric key pad 48 allows alternate functions, such as the addressing of one of multiple trains.

Figure 3:
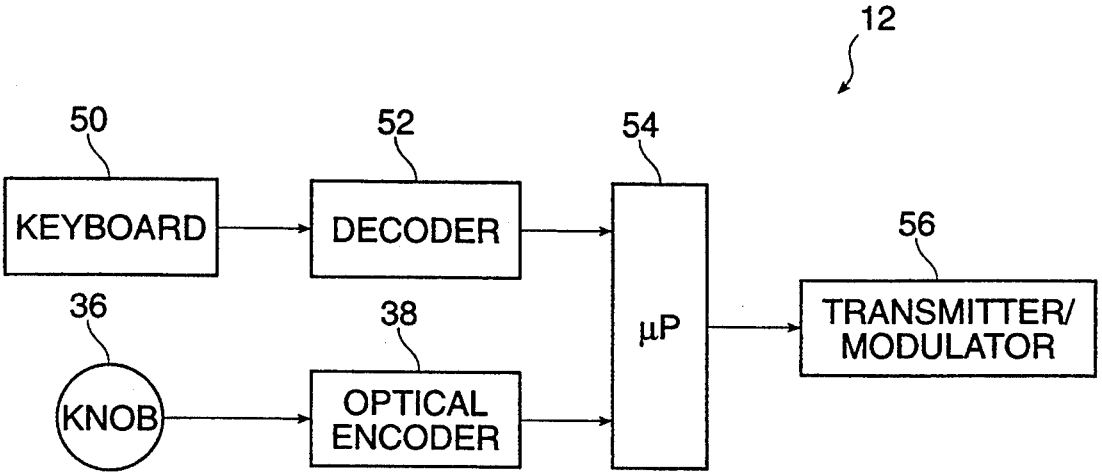
FIG. 3 is a block diagram of the electronics of the hand-held remote unit of FIG. 2.

FIG. 3 is a block diagram of the circuitry of the hand-held remote unit 12 of FIG. 2. The keyboard inputs 50 are provided through a decoder 52 to a microprocessor 54. The knob 36 for controller unit speed uses an optical encoder 38, similar to those used for computer mice or track balls. The output of optical encoder 38 is provided to microprocessor 54, which interprets the signals and provides them to a transmitter and demodulator 56 for transmission to the base unit. Transmitter/modulator 56 is preferably a radio transmitter.

Figure 4:
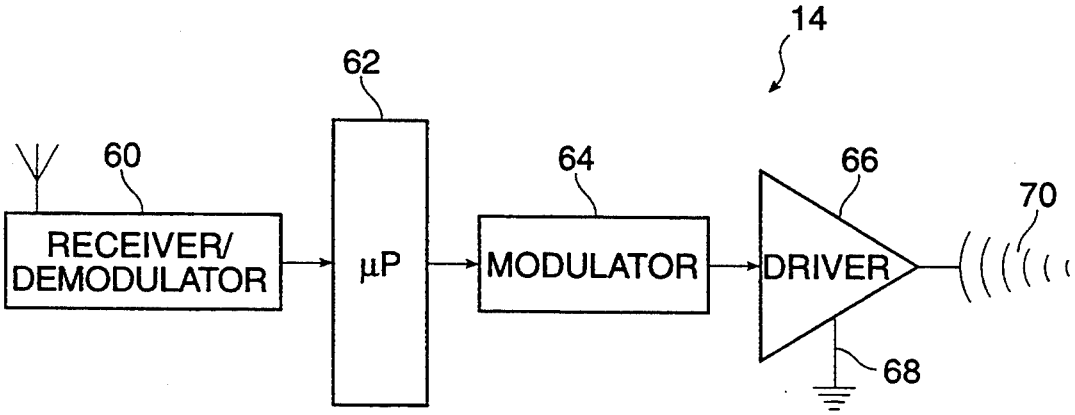
FIG. 4 is a block diagram of the base unit of FIG. 1.

FIG. 4 is a block diagram of base unit 14 of FIG. 1. A receiver/demodulator 60 receives the RF signals from the hand-held remote unit. These are provided to a microprocessor 62, which puts the commands in the proper form for transmission to the trains and then provides them to a modulator 64. Modulator 64 performs FM modulation and provides these signals through a driver 66 between earth ground 68 and a rail 70 of the track.

Figure 5:
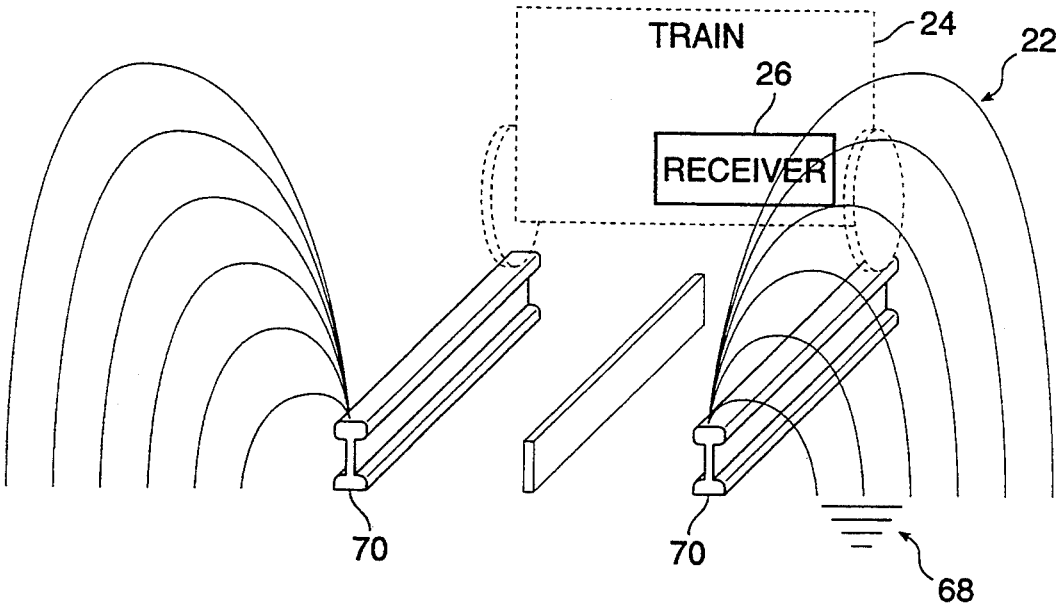
FIG. 5 is a diagram illustrating the generation of the electromagnetic field according to the present invention.

FIG. 5 illustrates in another view the electromagnetic field 22 generated between track rail 70 and earth ground 68. In the preferred embodiment, the signal used is a 455 Khz frequency shift keyed (FSK) signal at 5 volts peak-peak. This signal creates a field detectable within a few inches of the track. The field will propagate along the track, and be detected by a receiver 26 in a train locomotive 24.

Figure 6:
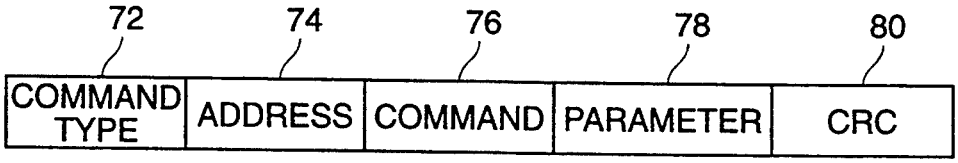
FIG. 6 is a diagram of the command protocol of the present invention.

FIG. 6 shows the protocol used by the system of FIG. 1. A message transmitted by hand-held remote 12 and received by base unit 14 will have the fields set forth in FIG. 6. A command-type field 72 identifies the type of command. For example, a first command-type would be for the system controller 30. A second command-type would be for a transmission to the trains. The second field 74 sets forth the address. For example, if the command is for the trains, the address will set forth a particular train to which it is to be directed. Alternately, for the switch controller command, it will designate which of the remote switches is to be activated.

The next field 76 is the command itself. For example, it might say to increase the track power or activate a certain sound module. The following parameter field 78 would then indicate the parameters of the command, such as the level to which power to the train motor is to be increased or the amount or frequency of the sound to be generated. The last field contains a cyclic redundancy code (CRC) 80 which is used for error checking.

The use of the same protocol throughout the system allows for the distributed processing accomplished in the system of FIG. 1. Each control node can look at the different fields of the protocol. For instance, microprocessor 62 in base unit 14 will direct the message according to the command-type 72. The trains on the track will receive it in accordance with the address, and then decode it for the command parameter.

The command type 72 might indicate that it was intended for direct receipt by, for instance, sound module 31 on the train track layout. This sound module could have its own detector, and respond to only a certain command type.

The base unit of FIG. 4 can operate with several hand-held remote units. Each hand-held remote can transmit a signal to the base unit, and, in one embodiment, may use the command type field 72 to indicate which hand-held remote it is. Alternately, different frequencies can be assigned to different hand-held remote units. Microprocessor 62 of base unit 14 will monitor for collisions between two hand-held remote units transmitting at the same time. If a collision is detected, the signal will be ignored until a retransmission in the clear by one of the hand-held remote units is received. The likelihood of collisions is fairly limited with a small number of hand-held remote units.

Figure 7:
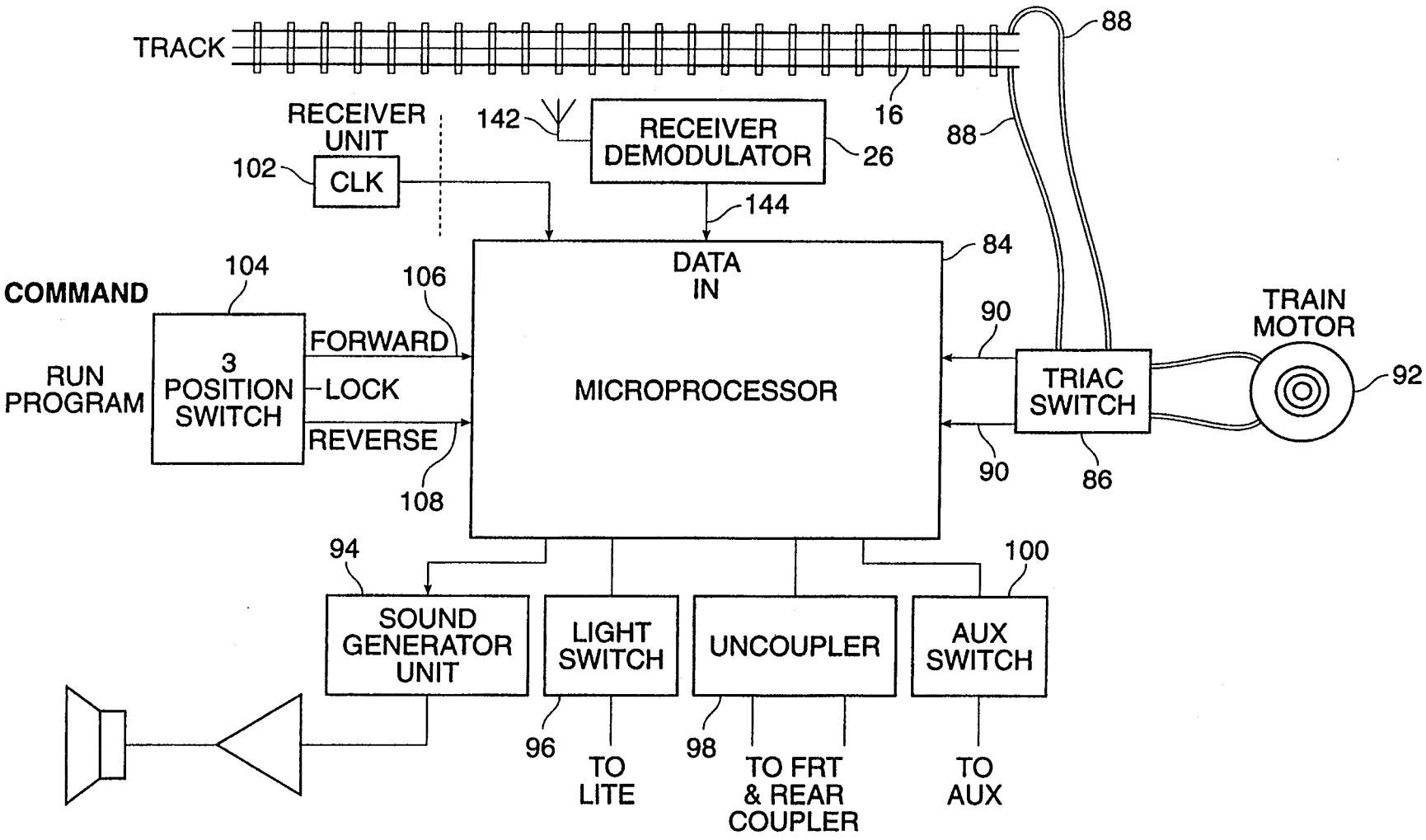
FIG. 7 is a block diagram of the receiver and controller circuitry on a locomotive according to the present invention.

FIG. 7 is a block diagram of the circuitry inside of a train 24 running on track 16. A receiver demodulator circuit 26 picks up the electromagnetic field signals, and provides them to a data input of a microcontroller 84. The receiver is preferably an FM receiver chip such as the MC3361 manufactured by Motorola. The microcontroller is preferably a 16C84 microprocessor. The microprocessor controls a triac switching circuit 86. One side of the triac switches are connected to the train tracks through leads 88 which pick up power physically from the track. When activated by control signals from microcontroller 84 on lines 90, the triac switching circuit 86 will provide power to train motor 92, which moves the wheels of the train.

The microcontroller also has separate, dedicated output pins which can control a sound generator unit 94, a light switch 96, a coupler 98 and an auxiliary switch 100. The microcontroller is powered by an on-board clock 102.

A three position manual switch 104 is provided. In a first mode, the switch indicates on a line 106 that the train is to start in the forward direction. When in a second position, a signal on a line 108 indicates that the train is to start in the reverse direction. When the switch is in-between the two lines, in a "lock" mode, the microcontroller knows to start the train in the last direction it was in.

The same switch 104 can perform a second function. When a control command is received by the microcontroller, it knows to use the position of switch 104 to indicate either a "run" mode when the switch is in position 106, or a "program" mode when the switch is in the position on line 108.

In order to program an address into a train, the manual switch is moved into the program mode and the train is put on the track. The remote unit is then used to provide an address program command with a designated address for that train. This command is received by the receiver 26 and provided to microcontroller 84, which knows it should write into its memory that address as its designated address. Thereafter, in the run mode, the microcontroller will respond only to commands associated with that address.

Figure 8:
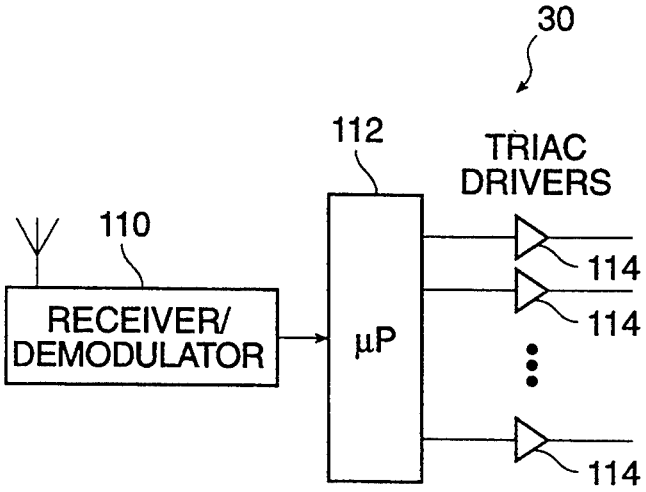
FIG. 8 is a diagram of a switch controller coupled to the tracks of the present invention.

FIG. 8 is a block diagram of the switch controller 30 of FIG. 1, which is a simplified version of the circuitry in the train in FIG. 7. The switch controller contains a receiver/demodulator 110, which is coupled to a microprocessor 112. The microprocessor would drive an appropriate one of triac drivers 114, which couple power to the different track switches, lights, etc. around the track system. Microprocessor 112 can be a simple controller or a decoder in one embodiment.

Figure 9:
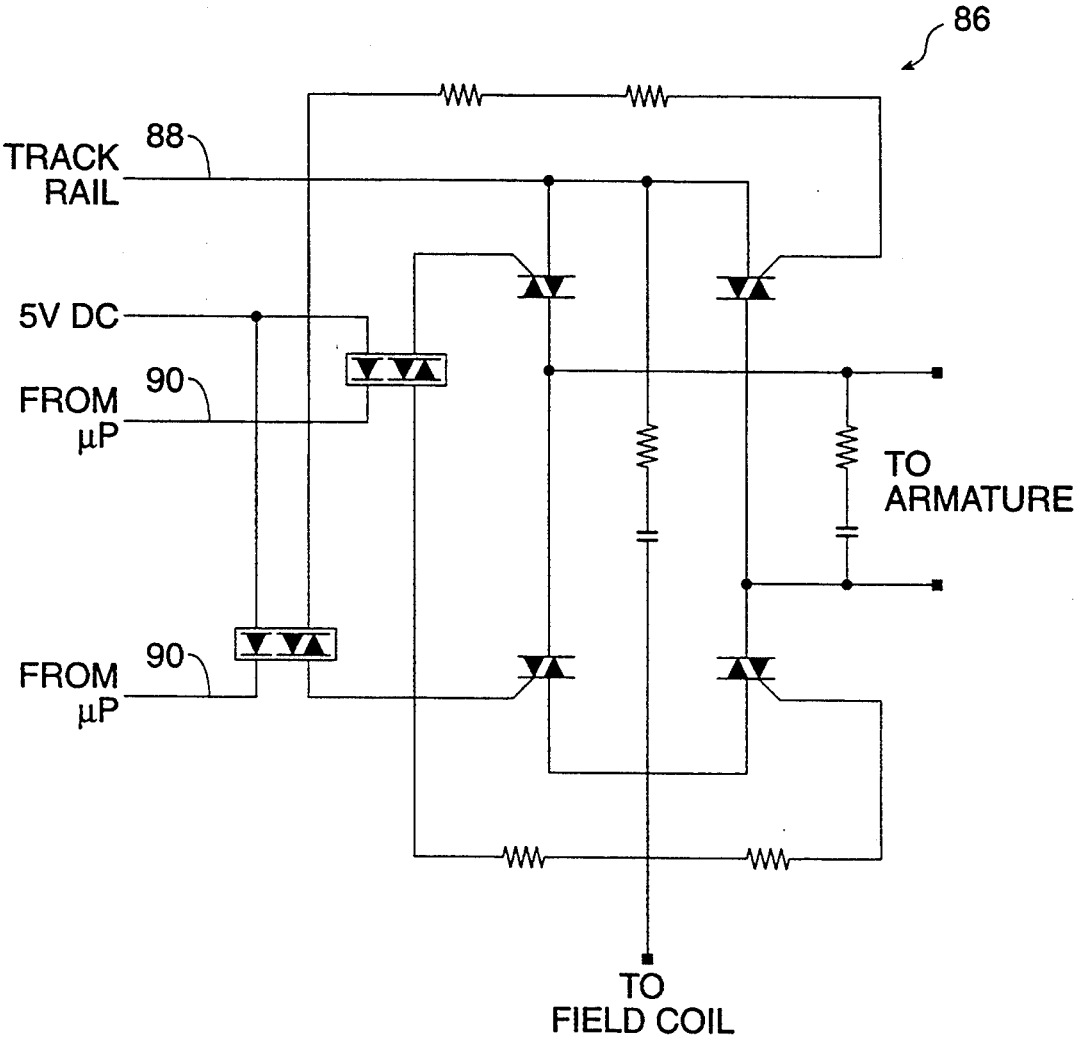
FIG. 9 is a circuit diagram of the triac switch circuit of FIG. 7.

FIG. 9 is a circuit diagram illustrating a preferred embodiment of the triac switch circuit 86 of FIG. 7. The triac switches switch the connections between the armature and field coils of the motor to reverse its direction in accordance with control signals received on lines 90 from the microprocessor.

Figure 10A:
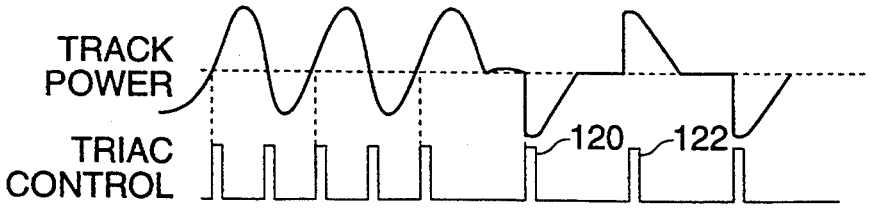
FIGS. 10A–10C are timing diagrams illustrating the control of the speed of a locomotive using the triac switches of FIG. 9.

FIG. 10A illustrates the track power signal provided to the train motor 92 as it is controlled by the triac switch circuit 86. The triac control pulses from microprocessor 84 are shown immediately below. In order to allow remote control of the power applied to the motor, and thus the speed of the trains, transformer 20 of FIG. 1 is set to a maximum desired level. The AC power waveform is then modulated by the triac switches under the control of microprocessor 84, which is in turn controlled by the user from the remote control unit. As can be seen, in the first part of FIG. 10, full power is applied to the track. This is accomplished by pulsing the triac at each zero crossing of the power signal to turn the triac on in the positive or negative going direction, respectively. The microprocessor knows when to pulse the triac in a synchronized manner with the AC 60 Hz signal because in the preferred embodiment, communication is synchronized to the zero crossings. When it is desired to decrease the power applied from the track, the pulses are simply applied after the zero crossing. When the AC signal crosses zero, it automatically shuts off, bringing its value to zero, until it is pulsed by the triac. Thus, when the triac control is first varied, the signal goes to zero until it is pulsed by a triac pulse 120. Subsequently, the positive going triac pulse is also delayed to a time 122, thus cutting the amount of the positive part of the waveform as well. The power applied is equal to the area under the curves, which is cut almost in half in the diagram shown in FIG. 10A. By appropriately varying the timing, the power applied to the motor can be controlled.

In an alternate embodiment, the system of the present invention can be used with existing trains which do not have the sophisticated control circuitry of FIG. 7. In those cases, a triac switching circuit in a base unit itself can be used to control the track power applied to all trains. This can also be used to apply a DC offset to the track, which is detected as a control signal by existing trains.

Figure 10B:
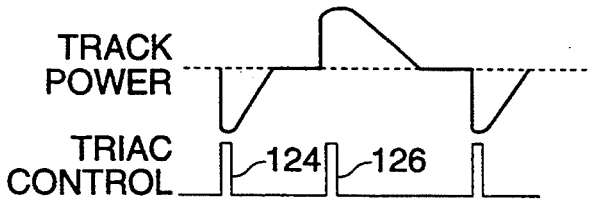

A DC offset can be applied to the track by appropriately controlling the triac switches. As could be seen in FIG. 10A, the triac control pulses were equally spaced so that the positive and negative pulses would be even. By varying the phase, such as shown in FIG. 10B, an offset can be generated. As can be seen in FIG. 10B, a pulse 124 occurs relatively late after the negative-going zero-crossing, giving a small negative waveform. On the other hand, a pulse 126 occurs shortly after the positive-going zero-crossing, thus only clipping a small portion of the positive-going waveform. This gives an overall DC offset when the values are averaged. This DC offset is detected by circuitry or relays in the train itself. As can be seen, the triac pulses of FIG. 10B do double duty. They not only impose a DC offset, but also control the AC track power signal. The delay of the pulse after the zero crossing controls the track power while the differential between the negative going and positive going trigger pulses controls the amount of the DC offset. Evenly spaced pulses produce zero DC offset.

Figure 10C:
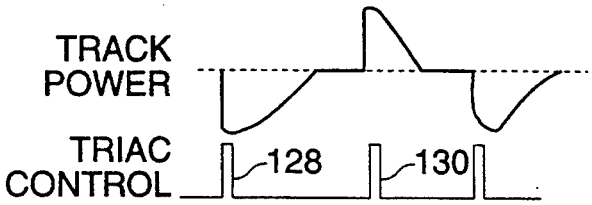

Similarly, FIG. 10C illustrates the imposition of a negative DC offset. A pulse 128 occurs shortly after the negative going zero crossing, while a pulse 130 occurs a longer time after a positive going zero crossing. This results in a net negative DC offset.

By appropriately controlling the track power, a DC offset can be imposed without varying the power applied to the train, as required in prior art systems. Since it is the phase variation which causes the DC offset, the total area under the curve can be maintained to preserve the same power to the train. For instance, if a positive DC offset is imposed by clipping less of the positive signal or clipping more of the negative signal, the amount clipped can be controlled so that the total area is still the desired power. The greater amount clipped in a negative region is made up for by less being clipped in the positive region so that the overall power remains the same. This eliminates the annoying effect of having the train slow down when a DC offset is attempted to be applied to control the whistle or other effects on the train.

Figure 11:
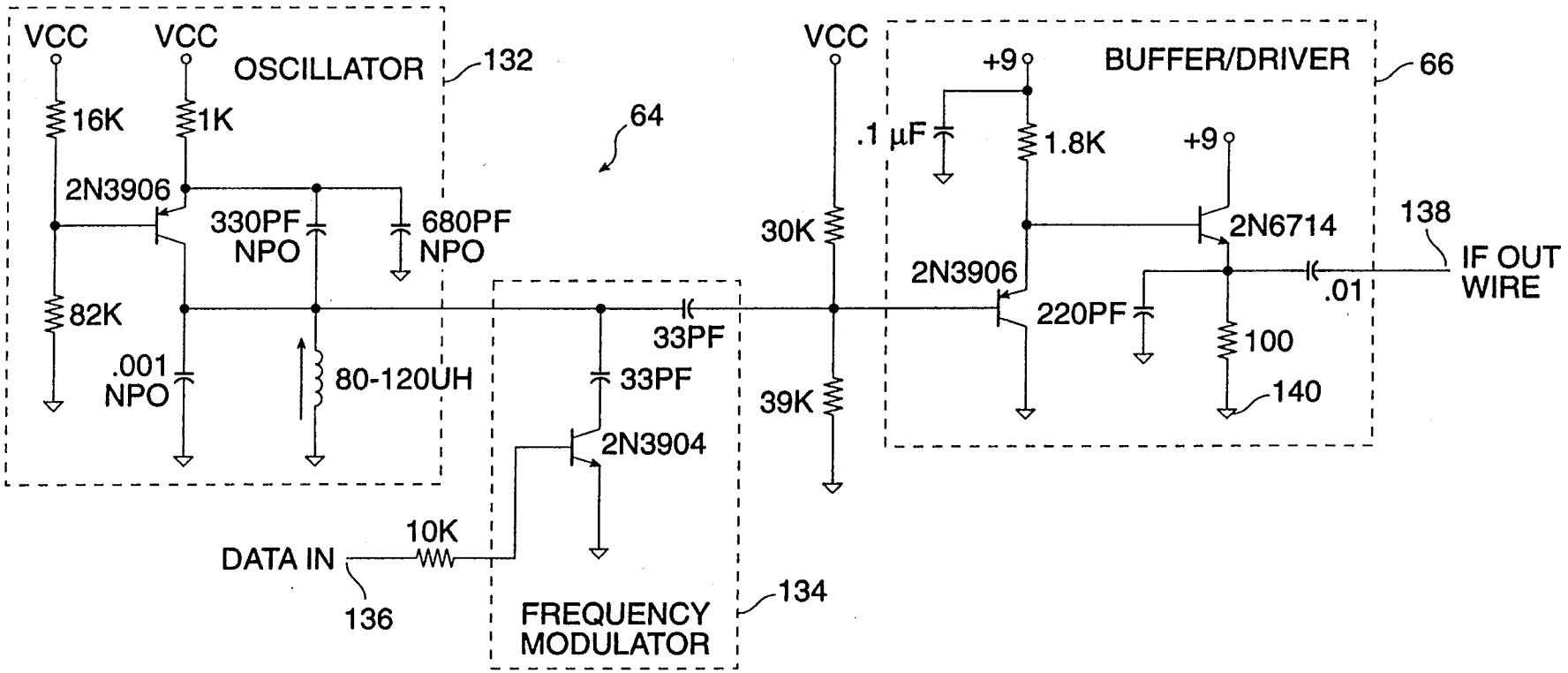
FIG. 11 is a circuit diagram of the modulator and driver blocks of the base unit of FIG. 4.

FIG. 11 is a circuit diagram of a base unit modulator and driver circuitry. The modulator 64 is composed of an oscillator 132 and a frequency modulator 134, which receives the data input from microprocessor 62 of FIG. 4 on line 136. A buffer/driver circuit 66 provides the output signal to the train track between line 138 connected to the rail of the track and earth ground 140.

Figure 12:
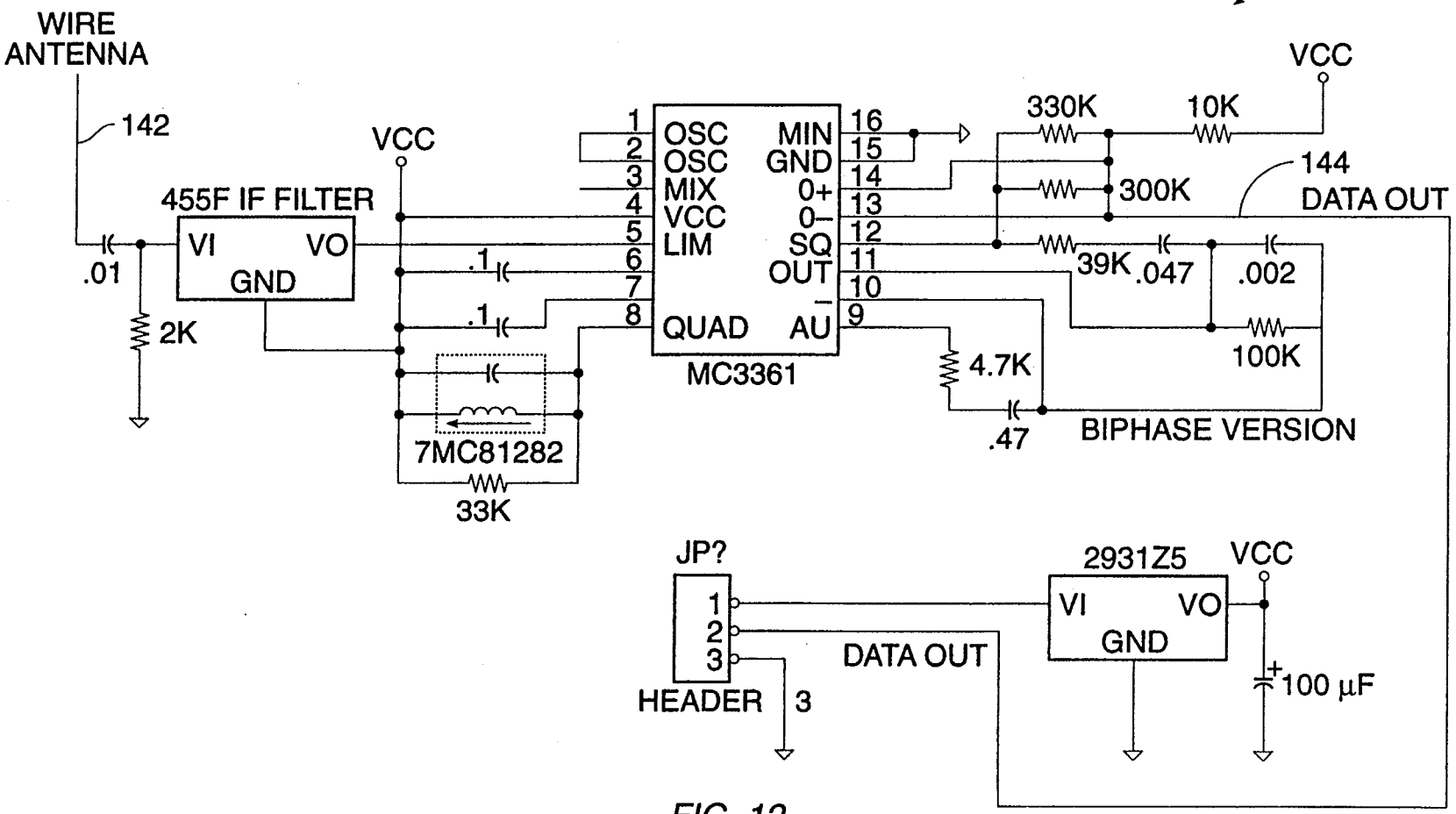
FIG. 12 is a circuit diagram of the train receiver/-demodulator block of FIG. 7.

FIG. 12 is a circuit diagram of the train receiver/demodulator circuit 26 of FIG. 7. Signals are received via a wire antenna 142 and provided on an input 144 to microprocessor 84 of FIG. 7.

As will be understood by those familiar with the art, the present invention can be embodied in other specific forms without departing from the spirit or essential characteristics thereof. For example, a frequency other than 455 Khz could be used for the transmission along the train track. Alternately, a transmission method other than radio can be used from the remote to the base unit, such as an IR signal. In addition, the invention could be applied to vehicles other than model trains which run on a track. Accordingly, the disclosure of the preferred embodiment of the invention is intended to be illustrative, but not limiting, of the scope of the invention which is set forth in the following claims.

What is claimed is:

1. A control system for transmitting control signals to a model vehicle on a track, comprising:

input means for accepting user input signals;

control means, coupled to said input means, for generating control signals for said model vehicle; and a transmitter, coupled to said control means, connected between a rail of said track and earth ground, for transmitting said control signals between said rail of said track and earth ground to generate an electromagnetic field above said track, such that said control signals can be received by a receiver on said model vehicle from said electromagnetic field.

2. The control system of claim 1 further comprising a radio frequency receiver on said model vehicle, said transmitter being a radio frequency transmitter.

3. The control system of claim 1 further comprising a hand-held remote transmitter for transmitting user input signals to said input means.

4. The control system of claim 1 further comprising a transformer coupled to two rails of said track in addition to said transmitter for providing power to said track.

5. The control system of claim 1 wherein said model vehicle includes:

a receiver for receiving said control signals through said electromagnetic field;

a microprocessor coupled to said receiver;

an electric motor for driving said model vehicle; and a switching circuit coupled between said track and said electric motor, having a control input coupled to an output of said microprocessor.

6. The control system of claim 5 wherein said model vehicle further includes:

a manual switch having run and program positions coupled to first and second outputs coupled to said microprocessor;

said microprocessor being programmed to store an address received from said transmitter when accompanied by an address programming command when said manual switch is in said program position.

7. The control system of claim 6 wherein said microprocessor is programmed to cause said switching circuit to start said motor in a forward direction when said manual switch is in a first one of said positions and no commands have been received, and to start said motor in a reverse direction when said manual switch is in a second one of said positions and no command is received.

8. The control system of claim 7 wherein said microprocessor is programmed to cause said switching circuit to start said motor in a last used direction when said switch is in neither of said first and second positions.

9. The control system of claim 5 wherein said switching circuit comprises at least one triac.

10. The control system of claim 5 wherein said microprocessor is programmed, responsive to a received speed command, to control the switching of said switching means to vary the time a track power signal from said track is applied to said motor to control the speed of said motor.

11. The control system of claim 10 further comprising a transformer coupled to said track to apply power to said track, said transformer being set to a full power level.

12. The control system of claim 10 wherein said track power signal is an AC signal, and the switching of said switching means is synchronous with said AC signal.

13. A control system for transmitting control signals to a model vehicle on a track, comprising:

input means for accepting user input signals;

control means, coupled to said input means, for generating control signals for said model vehicle;

a transmitter, coupled to said control means, for transmitting said control signals such that said control signals can be received by a receiver on said model vehicle;

a receiver on said model vehicle for receiving said control signals;

a processor coupled to said receiver;

an electric motor for driving said model vehicle;

a switching circuit coupled between said track and said electric motor, having a control input coupled to an output of said processor;

a manual switch having run and program positions coupled to first and second outputs coupled to said processor; and said processor being programmed to store an address received from said transmitter when accompanied by an address programming command when said manual switch is in said program position.

14. A control system for a model vehicles on a track system comprising:

a hand-held remote control unit for transmitting first control signals;

a transformer for applying track power to said track;

a base unit, connected to said track, for receiving said first control signals, and providing second control signals to said track;

a vehicle receiver unit, mounted in one of said model vehicles, for receiving said second control signals, and directing the operation of said one model vehicle in response to said second control signals.

* * * * *

US005441223C1

(12) REEXAMINATION CERTIFICATE (4303rd)

United States Patent

Young et al.

(10) Number: US 5,441,223 C1

(45) **Certificate Issued: *Apr. 3, 2001**

(54) MODEL TRAIN CONTROLLER USING ELECTROMAGNETIC FIELD BETWEEN TRACK AND GROUND

(75) Inventors: Neil P. Young, Redwood City; David M. Hampton, Nevada City, both of CA (US)

(73) Assignee: Liontech Company, Chesterfield, MI (US)

Reexamination Request:
No. 90/005,644, Feb. 25, 2000

Reexamination Certificate for:

| | |
|---|---|
| Patent No.: | **5,441,223** |
| Issued: | **Aug. 15, 1995** |
| Appl. No.: | **08/134,102** |
| Filed: | **Oct. 8, 1993** |

( * ) Notice: This patent is subject to a terminal disclaimer.

Related U.S. Application Data

(63) Continuation-in-part of application No. 07/833,869, filed on Feb. 11, 1992, now Pat. No. 5,251,856.

(51) Int. Cl.[7] ..... B61L 27/00; B61L 7/08

(52) U.S. Cl. ..... 246/4; 246/187 A; 104/300; 104/302; 446/455; 340/825.69

(56) References Cited

U.S. PATENT DOCUMENTS

| | | | | |
|---|---|---|---|---|
| 2,257,473 | | 9/1941 | McKeige et al. | 104/150 |
| 2,872,879 | | 2/1959 | Vierling | 104/149 |
| 3,024,739 | | 3/1962 | Smith et al. | 104/149 |
| 3,361,082 | | 1/1968 | Leslie | 104/151 |
| 3,675,586 | | 7/1972 | Haddad | 104/149 |
| 4,062,294 | * | 12/1977 | Cohen | 104/149 |
| 4,341,982 | | 7/1982 | Lahti et al. | 318/51 |
| 4,747,351 | * | 5/1988 | Baret | 104/297 |
| 4,914,431 | * | 4/1990 | Severson et al. | 340/825.69 |
| 5,448,142 | | 9/1995 | Severson et al. | 318/280 |

FOREIGN PATENT DOCUMENTS

| | | |
|---|---|---|
| 2011286 | 2/1971 | (DE) . |
| 2735521 | 2/1979 | (DE) . |
| 3022409 | 1/1982 | (DE) . |
| 3613429 | 10/1987 | (DE) . |
| 326769 | 3/1930 | (GB) . |
| 474863 | 11/1937 | (GB) . |
| 9315945 | 8/1993 | (WO) . |

OTHER PUBLICATIONS

"Electronic Toy Train Controls," Joseph L. Bonanno, *Electronics,* pp. 94–96 (Feb. 1947).

"A Cordless Walkaround Throttle," Don W. Hansen, *Model Railroader,* vol. 45 No. 5, pp. 3, 80–88 (May 1978).

*Model Railroader,* vol. 46, No. 4, pp 3, 13 (Apr. 1979).

"HO Radio Controlled Diesels," Trade Topics, *Model Railroader,* vol. 46, No. 6, pp. 3, 38 (Jun. 1979).

"Towards Reliable Operation," John Armstrong, *Model Railroader,* vol. 46, No. 9, pp. 3, 72–79 (Sep. 1979).

"Hi–Country Brass MRC Radio Control Power Packs," *Model Railroader,* vol. 46, No. 10, pp. 3, 10–11 (Oct. 1979).

"Commercial Command Control Systems," Andy Sperandeo, *Model Railroader,* vol. 46, No. 11, pp. 3, 80–81 (Nov. 1979).

"A Pulse–Tone, Walkaround Control System," Peter J. Thorne, *Model Railroader,* vol. 48, No. 2, pp. 3, 84–88 (Feb. 1981).

"Command Control/Sound System," Trade Topics, *Model Railroader,* vol. 48, No. 12, pp. 3, 48–54 (Dec. 1981).

"Symposium on Electronics," Don W. Hansen, *Model Railroader,* vol. 49, No. 3, pp. 3, 86–89 (Mar. 1982).

(List continued on next page.)

*Primary Examiner*—Mark T. Le

(57) ABSTRACT

A controller for model trains on a train track is provided. The controller transmits control signals between a rail of the track and earth ground, generating an electromagnetic field which extends for several inches around the track. A receiver in the locomotive can then pick up signals from this electromagnetic field.

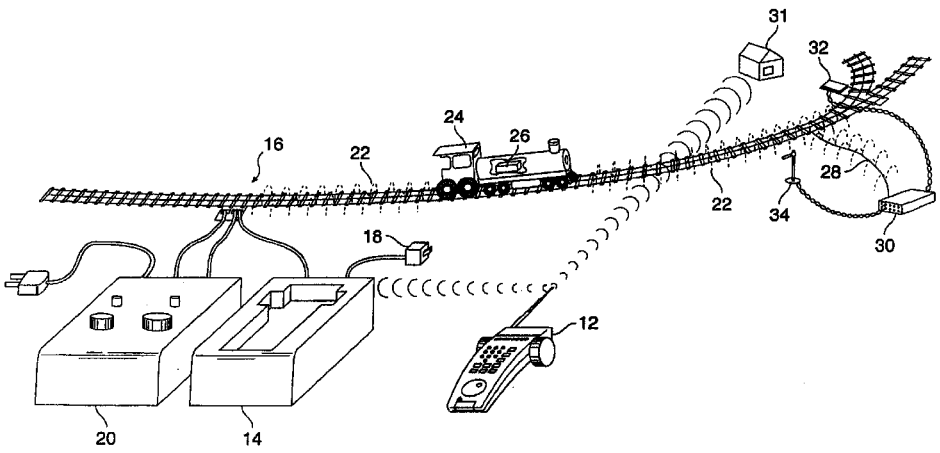

OTHER PUBLICATIONS

"Command Control Comes to the Sunset Valley," Bruce Chubb, *Model Railroader,* vol. 50, No. 1, pp. 3, 103–109 (Jan. 1983).
"CTC–16e: Command Control's Next Generation," Keith Gutierrez, *Model Railroader,* vol. 51, No. 4, pp. 3, 85–90 (Apr. 1984).
"Building the CTC–16e: 2," Keith Gutierrez, *Model Railroader,* vol. 51, No. 5, pp. 3, 84–91 (May 1984).
"Building the CTC–16e: 3," Keith Gutierrez, *Model Railroader,* vol. 51, No. 6, pp. 3, 68–72 (Jun. 1984).
"Building the CTC–16e: 4," Keith Gutierrez, *Model Railroader,* vol. 51, No. 7, pp. 3, 66–71 (Jul, 1984).
"Building the CTC–16e: Conclusion," Keith Gutierrez, *Model Railroader,* vol. 51, No. 8, pp. 3, 86–93 (Aug. 1984).
"Symposium on Electronics," Don Hansen, *Model Railroader,* vol. 52, No. 2, pp. 3, 116–121 (Feb. 1985).
"The C/MRI: A Computer/Model Railroad Interface," Bruce Chubb, *Model Railroader,* vol. 52. No. 2, pp. 3, 92–97 (Feb. 1985).
"The C/MRI: A Computer/Model Railroad Interface," Bruce Chubb, *Model Railroader,* vol. 52. No. 3, pp. 3, 92–98 (Mar. 1985).
"The C/MRI: A Computer/Model Railroad Interface," Bruce Chubb, *Model Railroader,* vol. 52. No. 4, pp. 3, 90–99 (Apr. 1985).
"The C/MRI: A Computer/Model Railroad Interface," Bruce Chubb, *Model Railroader,* vol. 52, No. 5, pp. 3, 92–99 (May. 1985).
"The C/MRI: A Computer/Model Railroad Interface," Bruce Chubb, *Model Railroader,* vol. 52. No. 6, pp. 3, 80–88 (Jun. 1985).
"Build an Inexpensive Walkaround Throttle," Kirk Wishowski, *Model Railroader,* vol. 53, No. 1, pp. 3, 118–122 (Jan. 1986).
"The C/MRI: A Computer/Model Railroad Interface," Bruce Chubb, *Model Railroader,* vol. 53. No. 8, pp. 3, 98–108 (Aug. 1986).
"Symposium on Electronics," Don W. Hansen, *Model Railroader,* vol. 53, No. 9 pp. 102–105 (Sep. 1986).
"CTC80 Command Control," Richard C. Kamm, *Model Railroader,* vol. 55, No. 3, pp. 3, 84–87 (Mar. 1988).
"Computers /in Model Railroading," Bob Fink, *Model Railroader,* vol. 55, No. 6, pp. 3, 66–69 (Jun. 1988).
"Wireless Walkaround Control for the CM&SF," Ken Thompson, *Model Railroader,* vol. 56, No. 8, pp. 3, 67–71 (Aug. 1989).
"Wireless Cab Control for the Great Southern," Lorell Joiner et al., *Model Railroader,* vol. 57, No. 1, pp 92–95 (Jan. 1990).
"Wireless Remote Control," John Atkinson, *Model Railroader,* vol. 57, No. 5, pp. 41, 43, 46 (May. 1990).
"The ABC's of Command Control," Keith Thompson, *Model Railroader,* vol. 60, No. 6, pp. 4–5, 104–106 (Jun. 1993).
"Command Control Roundup," Keith Thompson, *Model Railroader,* vol. 60, No. 7, pp. 88–93 (Jul. 1993).
"New Standards Proposed for Command Control," Stan Ames et al., *Model Railroader,* vol. 60, No. 10, pp. 4–5, 104–106 (Oct. 1993).
"Standards for Command Control?" Andy Sperandeo, *Model Railroader,* vol. 60, No. 10, pp. 4–5, 65 (Oct. 1993).
"The CTC–16: Part 4—handheld throttles", Gutierrez, 47 Model Railroader No. 3 (Mar. 1980), cover page and pp. 89–93.
"The CTC–16: Part 5—receivers", Gutierrez, 47 Model Railroader No. 4 (Apr. 1980), cover page and pp. 71–77.
"The CTC–16: epilogue", Gutierrez, 47 Model Railroader No. 12 (Dec. 1980), cover page and pp. 132–136.
"Build the wireless throttle: 1", Gutierrez, 50 Model Railroader No. 3 (Mar. 1983), cover page and pp. 86–95.
"Build the wirelss throttle: 2", Gutierrez, 50 Model Railroader No. 4 (Apr. 1983), cover page and pp. 68–75.
"Introducing the CTC–16", Gutierrez, 46 Model Railroader No. 12 (Dec. 1979), cover page and pp. 64–67.
"The CTC–16: Part 2—the command station", Gutierrez, 47 Model Railroader No. 1 (Jan. 1980), cover page and pp. 86–93.
"CTC–16: Part 3—the power station", Gutierrez, 47 Model Railroader No. 2 (Feb. 1980), cover page and pp. 89–92.

* cited by examiner

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–13 is confirmed.

Claim 14 is determined to be patentable as amended.

New claims 15–25 are added and determined to be patentable.

14. A control system for a model vehicles on a track system comprising:

a hand-held remote control unit for transmitting first control signals;

a transformer for applying *AC* track power to said track;

a base unit, connected to said track, for receiving said first control signals, and providing second control signals to said track;

a vehicle receiver unit, mounted in one of said model vehicles, for receiving said second control signals, and directing the operation of said one model vehicle in response to said second control signals.

*15. The control system of claim 14 wherein said remote control unit transmits said first control signals as radio frequency signals.*

*16. The control system of claim 14 wherein said remote control unit transmits said first control signals as infrared signals.*

*17. The control system of claim 14 wherein each of said first control signals includes an address and a command.*

*18. The control system of claim 17 wherein each of said first control signals further includes a parameter value associated with said command.*

*19. The control system of claim 14 wherein said receiver unit includes a decoder that receives said second control signals.*

*20. The control system of claim 14 wherein said receiver unit includes a microcontroller that controls said one model vehicle responsive to a set of said second control signals, each control signal of said set of second control signals having a predetermined address corresponding to said one model vehicle.*

*21. The control system of claim 14 further comprising a microprocessor coupled to said receiver unit, said microprocessor controlling a sound generator unit of said one model vehicle.*

*22. The control system of claim 14 further comprising a microprocessor coupled to said receiver unit, said microprocessor controlling a light controller of said one model vehicle.*

*23. The control system of claim 14 further comprising a microprocessor coupled to said receiver unit, said microprocessor controlling an uncoupler controller of said one model vehicle.*

*24. A control system for model vehicles on a track system comprising:*

*a hand-held remote control unit for transmitting first control signals;*

*a transformer for applying track power to said track;*

*a base unit, connected to said track, for receiving said first control signals, and providing second control signals to said track, said second control signals transmitted between said track and earth ground;*

*a vehicle receiver unit, mounted in one of said model vehicles, for receiving said second control signals, and directing the operation of said one model vehicle in response to said second control signals.*

*25. A control system for model vehicles on a track system comprising:*

*a hand-held remote control unit for transmitting first control signals;*

*a transformer for applying track power to said track;*

*a base unit, connected to said track, for receiving said first control signals, and providing second control signals to said track;*

*a vehicle receiver unit, mounted in one of said model vehicles, for receiving said second control signals, and directing the operation of said one model vehicle in response to said second control signals;* a microprocessor coupled to said receiver unit;

*an electric motor for driving said model vehicle; and,*

*a switching circuit coupled between said track and said electric motor, said switching circuit responsive to an output of said microprocessor.*

* * * * *